US009259926B2

(12) United States Patent
Yabe

(10) Patent No.: US 9,259,926 B2
(45) Date of Patent: Feb. 16, 2016

(54) LIQUID EJECTION APPARATUS AND LIQUID EJECTION HEAD

(71) Applicant: CANON KABUSHIKI KAISHA, Tokyo (JP)

(72) Inventor: Kenji Yabe, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/480,776

(22) Filed: Sep. 9, 2014

(65) Prior Publication Data

US 2015/0070433 A1 Mar. 12, 2015

(30) Foreign Application Priority Data

Sep. 10, 2013 (JP) ..... 2013-187347

(51) Int. Cl.
*B41J 29/393* (2006.01)
*B41J 2/14* (2006.01)

(52) U.S. Cl.
CPC ..... *B41J 2/14153* (2013.01); *B41J 2/14129* (2013.01); *B41J 2202/20* (2013.01)

(58) Field of Classification Search
CPC .. B41J 2/14233; B41J 2/14256; B41J 29/393; B41J 2/161; B41J 2/164
USPC ..... 347/19
See application file for complete search history.

(56) References Cited

U.S. PATENT DOCUMENTS

| | | | | | |
|---|---|---|---|---|---|
| 4,558,333 | A * | 12/1985 | Sugitani et al. | ..... | 347/65 |
| 4,777,494 | A * | 10/1988 | Shibata et al. | ..... | 347/64 |
| 4,860,033 | A * | 8/1989 | Shiozaki et al. | ..... | 347/64 |
| 6,609,783 | B1 * | 8/2003 | Koyama et al. | ..... | 347/58 |
| 2006/0213051 | A1 * | 9/2006 | Sugahara | ..... | 29/592.1 |
| 2010/0123759 | A1 * | 5/2010 | Matsui et al. | ..... | 347/63 |

FOREIGN PATENT DOCUMENTS

| | | | |
|---|---|---|---|
| JP | 2000-280477 | A | 10/2000 |
| JP | 2000280477 | A * | 10/2000 |

* cited by examiner

*Primary Examiner* — Julian Huffman
*Assistant Examiner* — Sharon A Polk
(74) *Attorney, Agent, or Firm* — Canon USA, Inc. IP Division

(57) ABSTRACT

A liquid ejection apparatus includes an energy generating element that generates energy for ejecting a liquid; a plurality of electroconductive protective films that are disposed so as to cover at least the energy generating element and that are in contact with the liquid; and an electrifying unit that is capable of electrifying the plurality of electroconductive protective films in such a way that surfaces of the electroconductive protective films in contact with the liquid serve as anodes.

19 Claims, 12 Drawing Sheets

LIQUID EJECTION APPARATUS AND LIQUID EJECTION HEAD

BACKGROUND OF THE INVENTION

1. Field of the Invention

The present invention relates to a liquid ejection apparatus and a liquid ejection head for ejecting a liquid.

2. Description of the Related Art

Some liquid ejection heads for ejecting a liquid include a recording element substrate and an ejection orifice member. The recording element substrate includes a plurality of energy generating elements for generating thermal energy used to eject a liquid. The ejection orifice member has ejection orifices from which the liquid is ejected. Heat generating resistor layers, which generate heat when electrified, are used as the energy generating elements. The heat generating resistor layers generate heat for forming bubbles in the liquid, and the liquid is ejected from the ejection orifices due to pressure generated by the bubbles.

The energy generating elements are covered with an insulation film, and a protective film is formed on the insulating film. The protective film is made of an electroconductive material, such as tantalum (Ta). The protective film serves to protect the energy generating elements from a cavitation impact that occurs when bubbles form and burst and from a chemical reaction that occurs in the liquid.

There is a concern that, if the insulation film of the liquid ejection head has a defect, such a hole (pin hole), the energy generating elements and the protective film may be electrically connected to each other, so that the protective film and the liquid may cause an electrochemical reaction, leading to degradation of the protective film. When degradation of the protective film occurs, the thermal efficiency of energy transferred from the energy generating element to the liquid changes. Therefore, it is necessary to check the electrical insulation between the energy generating elements and the protective film during the process of manufacturing the recording element substrate.

Japanese Patent Laid-Open No. 2000-280477 discloses an inkjet recording head including a protective film and a circuit for detecting whether or not an electric current flows through a protective film and a liquid (ink) in a flow path.

Such detection can be easily performed by connecting protective films in the same recording element substrate so as to be electrically connected to each other and by using a terminal provided in the substrate. On the other hand, when the protective films are electrically connected to each other in the recording element substrate, degradation of some of the protective films may affect all the protective films in the substrate.

Some liquid ejection heads, such as a full-line head, includes a plurality of recording element substrates. If the substrates described above, in each of which the protective films are electrically connected to each other, are used for a liquid ejection head of this type, the following problem may occur.

If the liquid ejection head is assembled by using a plurality of substrates including a substrate in which a protective film has a defect, the thermal efficiency of the protective film having a defect deviates from those of other substrates, and therefore the minimum energy required for ejecting a liquid varies. When the liquid ejection characteristics of some of the substrates vary as described above in a liquid ejection head having a plurality of substrates, such as a full-line head, recording becomes nonuniform.

The same problem may occur if a hole is formed in the protective films or the insulation films of some of the substrates during use of the liquid ejection head.

SUMMARY OF THE INVENTION

The present invention provides a liquid ejection apparatus that includes a liquid ejection head including a plurality of recording element substrates and that is capable of suppressing occurrence of nonuniform recording due to degradation of protective films in some of the substrates.

A liquid ejection apparatus includes an energy generating element that generates energy for ejecting a liquid; a plurality of electroconductive protective films that are disposed so as to cover at least the energy generating element and that are in contact with the liquid; and an electrifying unit that is capable of electrifying the plurality of electroconductive protective films in such a way that surfaces of the electroconductive protective films in contact with the liquid serve as anodes.

Further features of the present invention will become apparent from the following description of exemplary embodiments with reference to the attached drawings.

DESCRIPTION OF THE EMBODIMENTS

Liquid Ejection Head

Figure 2A:
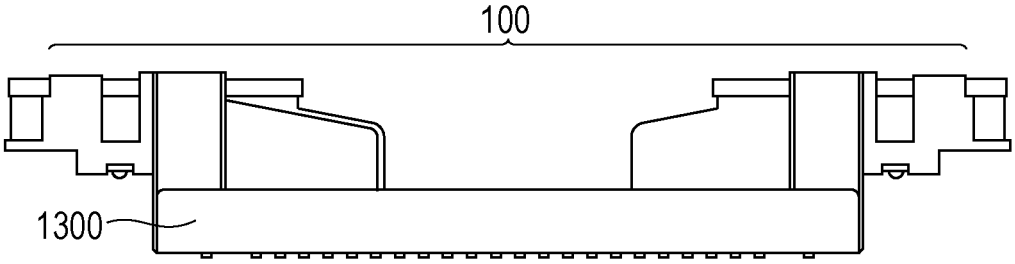
FIGS. 2A and 2B illustrate an inkjet recording head.
Figure 2B:
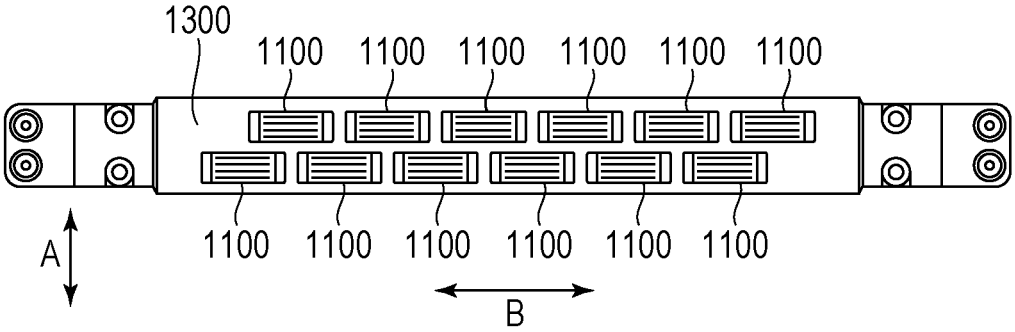

FIGS. 2A and 2B illustrate the structure of an inkjet recording head 100 (hereinafter, referred to as a "recording head"), which corresponds to a liquid ejection head according to the present invention. FIG. 2A is a side view of the recording head 100. FIG. 2B is a bottom view of the recording head 100, showing a surface from which an ink is ejected.

The recording head 100 according to the present embodiment is a full-line inkjet recording head, which can perform recording on a wide recording medium without scanning the recording medium. The recording head 100 includes a plurality of recording element substrates 1100 so as to cover the maximum width of a recording medium to be used.

Recording Element Substrate

Figure 3A:
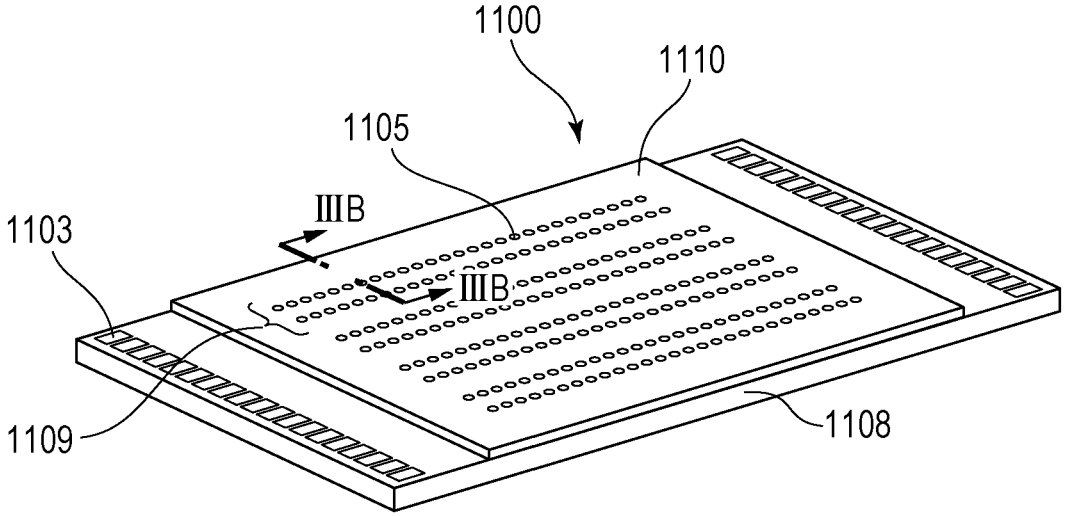
FIGS. 3A and 3B illustrate a recording element substrate.
Figure 3B:
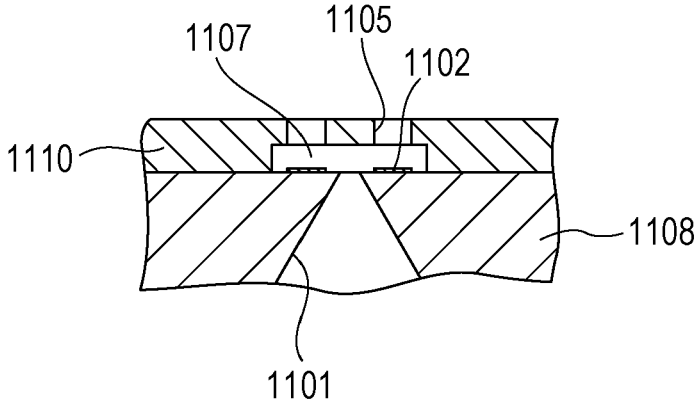

Referring to FIGS. 3A and 3B, the structure of one of the recording element substrates 1100 will be described. FIG. 3A is perspective view of the recording element substrate 1100. FIG. 3B is a sectional view taken along a line IIIB-IIIB of FIG. 3A.

The recording element substrate 1100 includes a substrate 1108 in which ink supply holes 1101 are formed. The substrate 1108 has a thickness of, for example, 0.5 to 1 mm. Each of the ink supply holes 1101 is a long-groove-shaped through-hole. On both sides of the ink supply hole 1101, heat application portions 1102 are arranged along a pair of rows in a staggered manner. Electrode terminals 1103 for supplying electric power are disposed at ends of the recording element substrate 1100. An ejection orifice member 1110 is disposed on the substrate 1108. In the ejection orifice member 1110, ejection orifices 1105, bubble-generating chambers 1107, and ink flow paths are formed so as to correspond to the heat application portions 1102 by photolithography. The ejection orifices 1105 are disposed so as to face the heat application portions 1102. An ink is supplied from the ink supply hole 1101, the heat application portions 1102 apply thermal energy to the ink to generate bubbles, and therefore the ink is ejected.

As illustrated in FIG. 3A, the recording element substrate 1100 has a plurality of ejection orifice rows 1109. In the present embodiment, four ink supply holes 1101 are formed so as to correspond to four sets of ejection orifice rows 1109. Ink having the same color may be supplied through the plurality of ink supply holes 1101 of the recording element substrate 1100. Alternatively, inks of four colors, such as cyan, magenta, yellow, and black may be supplied through the four ink supply holes 1101.

Figure 4:
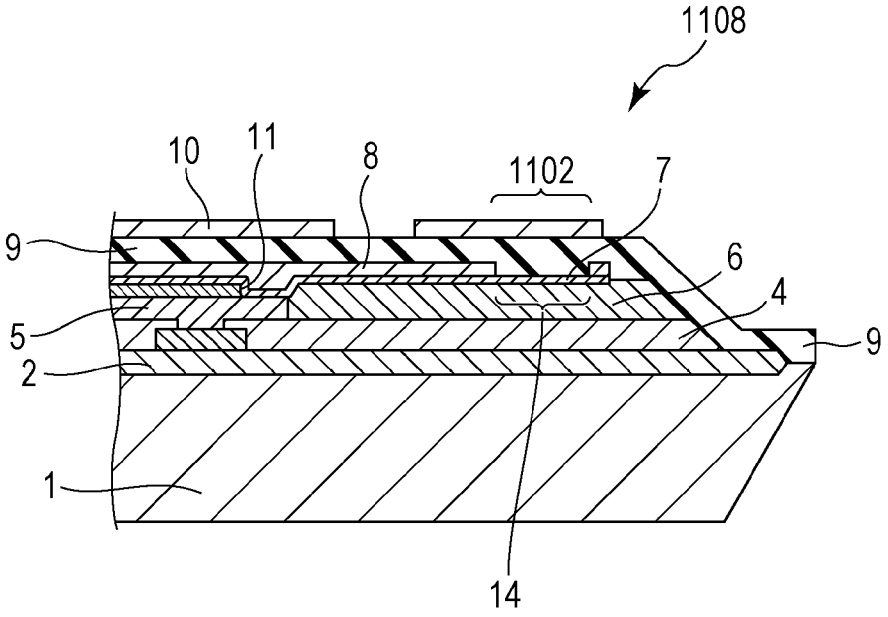
FIG. 4 is a schematic cross-sectional view illustrating the layered structure of the recording element substrate.

Referring to FIG. 4, the layer structure of the recording element substrate 1100 will be described. The ejection orifice member 1110 is not illustrated in FIG. 4.

A Si substrate or a Si substrate having an embedded drive IC is used as a substrate 1. A heat accumulating layer 2, which is formed by thermal oxidation or the like, is disposed on the substrate 1. A heat accumulating layer 4, which is formed by CVD or the like, is disposed on the heat accumulating layer 2. Common bus wiring 5 is formed on the heat accumulating layer 4 by forming a wiring layer by sputtering, forming a pattern by photolithography, and etching the wiring layer by reactive ion etching. The common bus wiring 5 is made of Al, Cu, Al—Si, Al—Cu, or the like. An insulation film 6, which is made from SiO2 or the like by sputtering and plasma CVD, is disposed on the common bus wiring 5. A through-hole portion 11 is formed in the insulation film 6 by forming a through-hole pattern by photolithography or the like and etching the insulation film 6 by dry etching or the like.

A heat generating resistor layer 7, which is made of TaN, TaSiN, or the like, and individual electrode wiring 8, which is made of Al, Cu, Al—Cu, Al—Si or the like, are formed on the insulation film 6 by reactive sputtering. A pattern is formed by photolithography on the heat generating resistor layer 7 and the individual electrode wiring 8, and the layer 7 and the wiring 8 are continuously etched by reactive ion etching or the like. Moreover, a part of the individual electrode wiring 8 is removed by photolithography and wet etching. This part of the heat generating resistor layer 7, which is exposed from the individual electrode wiring 8, serves as an electrothermal transducer 14, which corresponds to an energy generating element. The heat generating resistor layer 7 and the individual electrode wiring 8 may be stacked in the opposite order.

An insulation film 9, which is made of SiN, is formed on the individual electrode wiring 8 by plasma CVD. An anti-cavitation film 10 (hereinafter, referred to as a "protective film"), which corresponds to an electroconductive protective film, is formed on the insulation film 9 by sputtering. The protective film 10 is disposed at least in an upper part of the substrate 1108 corresponding to the electrothermal transducer 14. A part of the protective film 10 that is positioned in the upper part corresponding to the electrothermal transducer 14 and that contacts ink functions as the heat application portion 1102. In the present embodiment, a tantalum (Ta) film is used as the protective film 10. The materials of the recording element substrate 1100 described above are examples, and the materials are not limited to the aforementioned substances.

Electric Wiring Substrate

Figure 5:
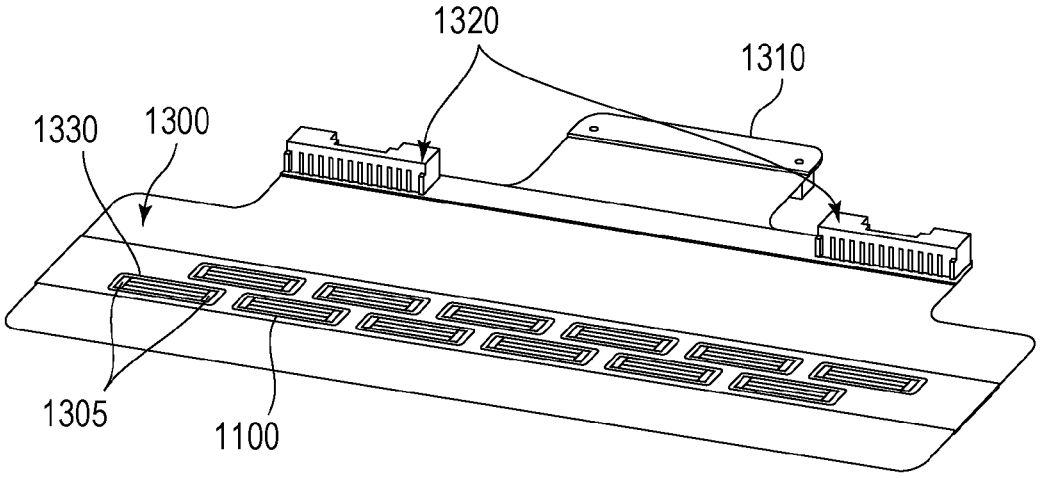
FIG. 5 is a schematic view illustrating an electric wiring substrate.

FIG. 5 illustrates the structure of an electric wiring substrate 1300. The recording element substrates 1100 are also shown in FIG. 5.

The electric wiring substrate 1300 electrically connects the recording element substrates 1100 to the body of an inkjet recording apparatus 3000. Electrical signals, electric power, and the like, which are supplied from the outside and used to eject ink, are supplied to the recording element substrates 1100 through the electric wiring substrate 1300. In the present embodiment, the electric wiring substrate 1300 is a flexible wiring substrate in which wiring is formed on a resin film.

The electric wiring substrate 1300 has a plurality of openings 1330, in which the recording element substrates 1100 are placed. The electric wiring substrate 1300 includes electrode terminals (not shown), an electric signal connector 1310, and a power connector 1320. The electrode terminals are provided so as to correspond to the electrode terminals 1103 of the recording element substrate 1100. The electric signal connector 1310 is disposed at an end of wiring and receives electric signals from the body of the inkjet recording apparatus 3000. The power connectors 1320 receive electric power.

The electric wiring substrate 1300 and the recording element substrates 1100 are electrically connected to each other by, for example, connecting the electrode terminals 1103 of the recording element substrates 1100 to the electrode terminals of the electric wiring substrate 1300 by wire bonding using a gold wire. The electrode terminals 1103 of the recording element substrate 1100, the electrode terminals of the electric wiring substrate 1300, and the bonding wires are covered by sealants 1305, so that these terminals and wires are protected from corrosion due to ink and from an external shock.

Inkjet Recording Apparatus

Figure 6:
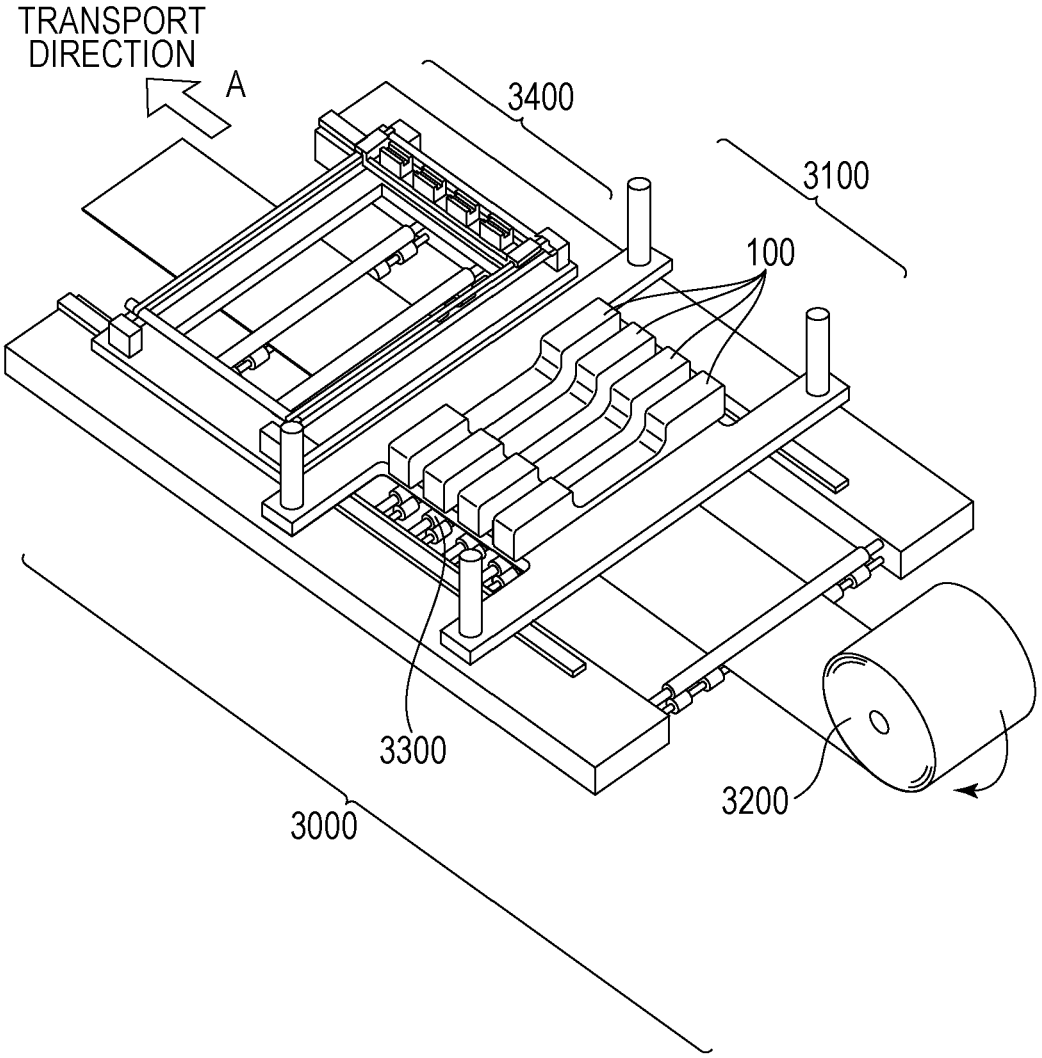
FIG. 6 is a schematic view illustrating an inkjet recording apparatus.

Referring to FIG. 6, the structure of the inkjet recording apparatus 3000, in which the inkjet the recording heads 100 are mounted, will be described.

The recording apparatus 3000 is a line printer that performs printing on a recording sheet, which corresponds to a recording medium, by using the recording heads 100, each of which is a long full-line head, while continuously transporting the recording sheet in a transport direction (direction A). The recording apparatus 3000 includes a holder, a transport mechanism 3300, and a recording unit 3100. The holder holds a recording sheet 3200, which is, for example, a rolled continuous paper sheet. The transport mechanism 3300 transports the recording sheet 3200 at a predetermined speed in the direction A. The recording unit 3100 performs recording on the recording sheet 3200 by using the recording heads 100. The recording sheet 3200 is not limited to a continuous rolled sheet, and may be a cut sheet.

The recording unit 3100 includes the plurality of recording heads 100, which correspond to different ink colors. In the present embodiment, four recording heads 100 are provided so as to correspond to cyan, magenta, yellow, and black. However, there is no limitation on the number of ink colors.

Problem related to Defect of Recording Element Substrate

Referring to FIGS. 7A to 8C, which are partial sectional views of the recording element substrate 1100, a problem that arises when a defect occurs in the insulation film 9 or the protective film 10 of the recording element substrate 1100 will be described.

Figure 7A:
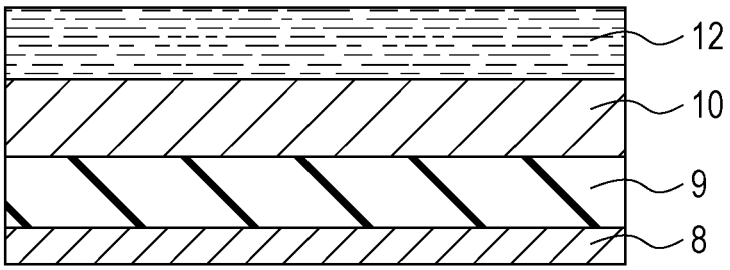
FIGS. 7A to 7C are schematic sectional views for illustrating a problem to be solved by the present invention.
Figure 7B:
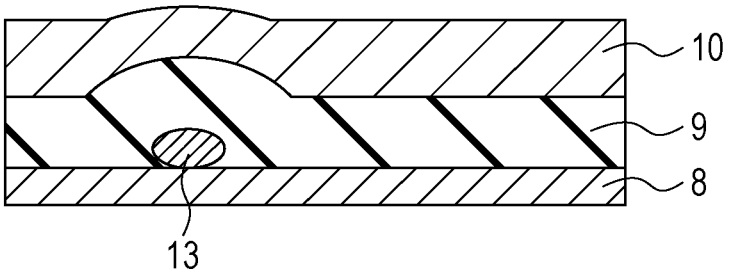
Figure 7C:
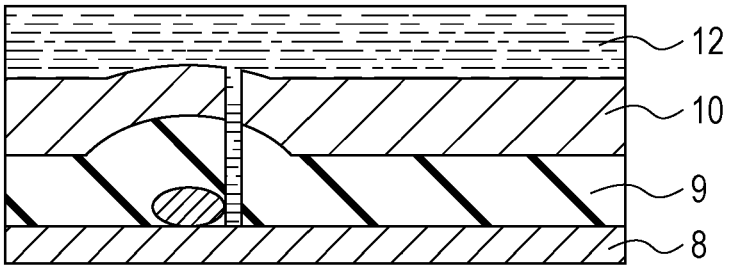
Figure 8A:
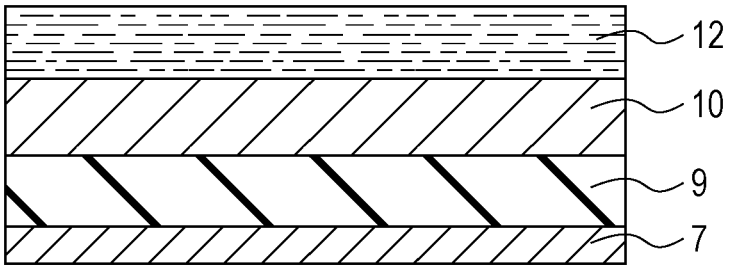
FIGS. 8A to 8C are schematic sectional views for illustrating another problem to be solved by the present invention.

FIGS. 7A and 8A illustrate a recording element substrate 1100 that does not have a defect. The numeral 12 denotes ink. As illustrated in FIG. 7B, when the films of the recording element substrate 1100 are being formed, a foreign matter 13 may adhere to one of the films. If the foreign matter 13 adheres to the individual electrode wiring 8, a bump is generated due to the foreign matter 13, and therefore the thicknesses of parts of the insulation film 9 and the protective film 10 formed on the foreign matter 13 may become smaller than appropriate thicknesses. If this occurs, when the recording head 100 is filled with ink and the electrothermal transducer 14 is driven, a thermal stress is applied to the thin parts of the films and a crack may be generated in the thin parts. As a result, as shown in FIG. 7C, the ink 12 passes through the protective film 10 to the individual electrode wiring 8, and therefore a short circuit may occur between the protective film 10 and the individual electrode wiring 8. Then, the surface of the protective film 10, including Ta, electrically serves as an anode, and an electrochemical reaction between the protective film 10 and the ink occurs. As a result, the surface or the inside of the protective film 10 may become oxidized (also referred to as "anodized") in a short time.

Figure 8B:
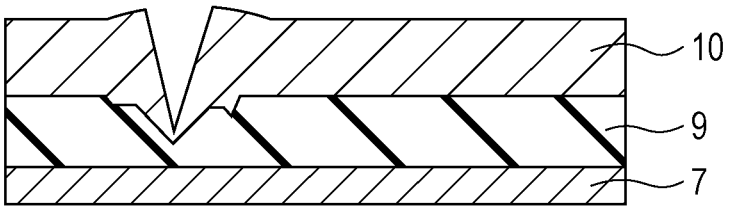
Figure 8C:
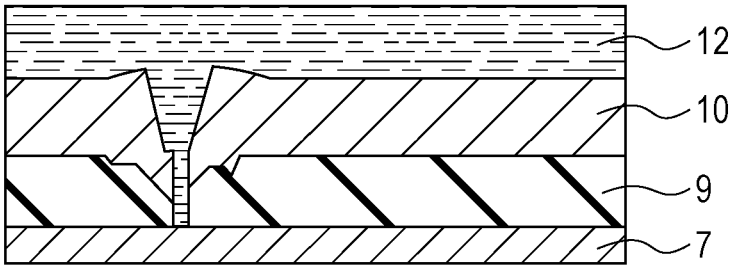

As illustrated in FIG. 8B, a defect in the protective film 10 may occur when the recording head 100 is being manufactured or during use of the recording head 100. If a defect occurs in the protective film 10, for protecting the heat generating resistor layer 7, and the defect extends to the insulation film 9, the ink 12 reaches the heat generating resistor layer 7 and causes a short circuit between the protective film 10 and the heat generating resistor layer 7. Then, in the same manner as described above, the surface of the protective film 10, including Ta, electrically serves as an anode, and an electrochemical reaction between the protective film 10 and the ink occurs, so that the surface or the inside of the protective film 10 may become oxidized in a short time.

If anodization of the protective film 10 occurs as described above, the crystalline state of the protective film 10 is changed and the thermal characteristics of the protective film 10 are changed. Because the protective film 10 is disposed on the electrothermal transducer 14, the minimum energy required for ejecting ink may be changed due to the change in the thermal characteristics of the protective film 10.

When ink is in contact with the surface of the protective film 10, anodization of the protective film 10 propagates to parts of the protective film 10 that are electrically connected to each other. For example, if an electrothermal transducer 14 of a recording element substrate 1100 has a defect, anodization occurs in a part of the protective film 10 located on the electrothermal transducer 14. Then, anodization propagates to a part of another protective film 10 that is electrically connected to the anodized protective film 10, the part being in contact with the ink. If the all of the protective films 10 in the recording element substrate 1100 are electrically connected to each other, anodization occurs almost uniformly in the recording element substrate 1100.

As described above, when the protective film 10 becomes anodized, the minimum energy required for ejection changes, and therefore the amount of ink in an ejected ink droplet and the ejection speed may be affected by the change. In particular, the recording head 100 according to the present embodiment includes a plurality of recording element substrates 1100. In this case, recording performed by a part of the recording head 100 corresponding to the anodized recording element substrate 1100 becomes nonuniform.

In the example described above, a Ta film is used as the protective film 10. However, a protective film 10 that can be used in the present embodiment is not limited to a Ta film, as long as oxidation occurs in the film when a voltage is applied to the film.

Method for Detecting Anodization

In the present embodiment, the recording head 100 and the recording apparatus 3000 include a detection unit for detecting anodization of the protective film 10. Hereinafter, a method for detecting anodization of the protective film 10 will be described.

Examples of a method for detecting anodization of the protective film 10 include a method of periodically measuring the minimum ejection energy of the recording element substrate 1100. For example, by periodically detecting a change in the minimum energy required for ejection, it is possible to determine that anodization of the protective film 10 has occurred if the minimum energy required for ejection has changed by an amount greater than equal to a predetermined threshold from the previous measurement. To perform such detection, the recording head 100 and the recording apparatus 3000 include an ejection detecting unit for detecting ejection of ink from the recording head 100. Examples of the ejection detecting unit includes a sensor or the like that detects ejection of a droplet and a scanner that scans a recording sheet to detect landing of a droplet on the recording sheet. At least one of the body of the recording apparatus 3000 and the recording head 100 includes an electrically erasable programmable read-only memory (EEPROM) or the like in order to store at least one of data of the minimum required ejection energy of each of the electrothermal transducers 14, the representative value of the data, and the statistics of the data. Moreover, at least one of the body of the recording apparatus 3000 and the recording head 100 includes a controller including a timer for periodically measuring a change in the minimum required ejection energy during use of the recording head 100.

The presence/absence of anodization in a protective film 10 may be detected by detecting a leakage current that flows when a voltage is applied to the electrothermal transducer 14 or by detecting the difference in the amount of light reflected by the protective film 10 using a microscope.

First Embodiment

Figure 1:
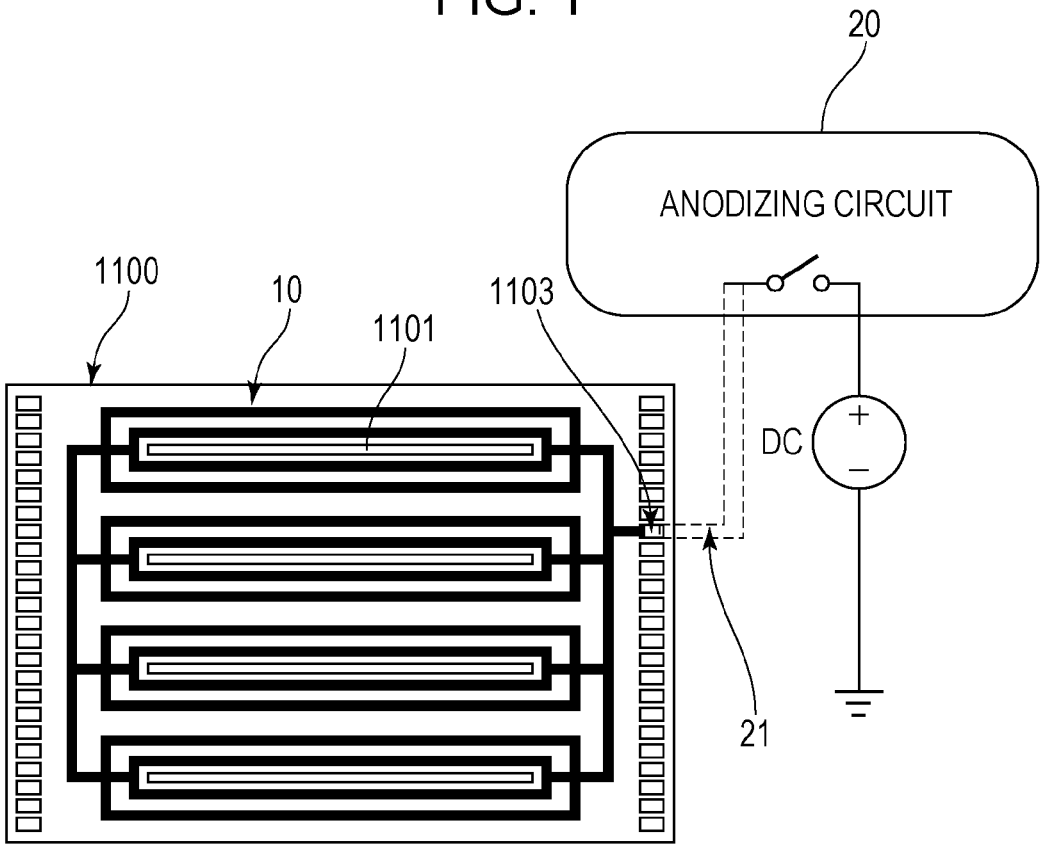
FIG. 1 is a schematic view illustrating a recording element substrate and an anodizing circuit according to a first embodiment.
Figure 9:
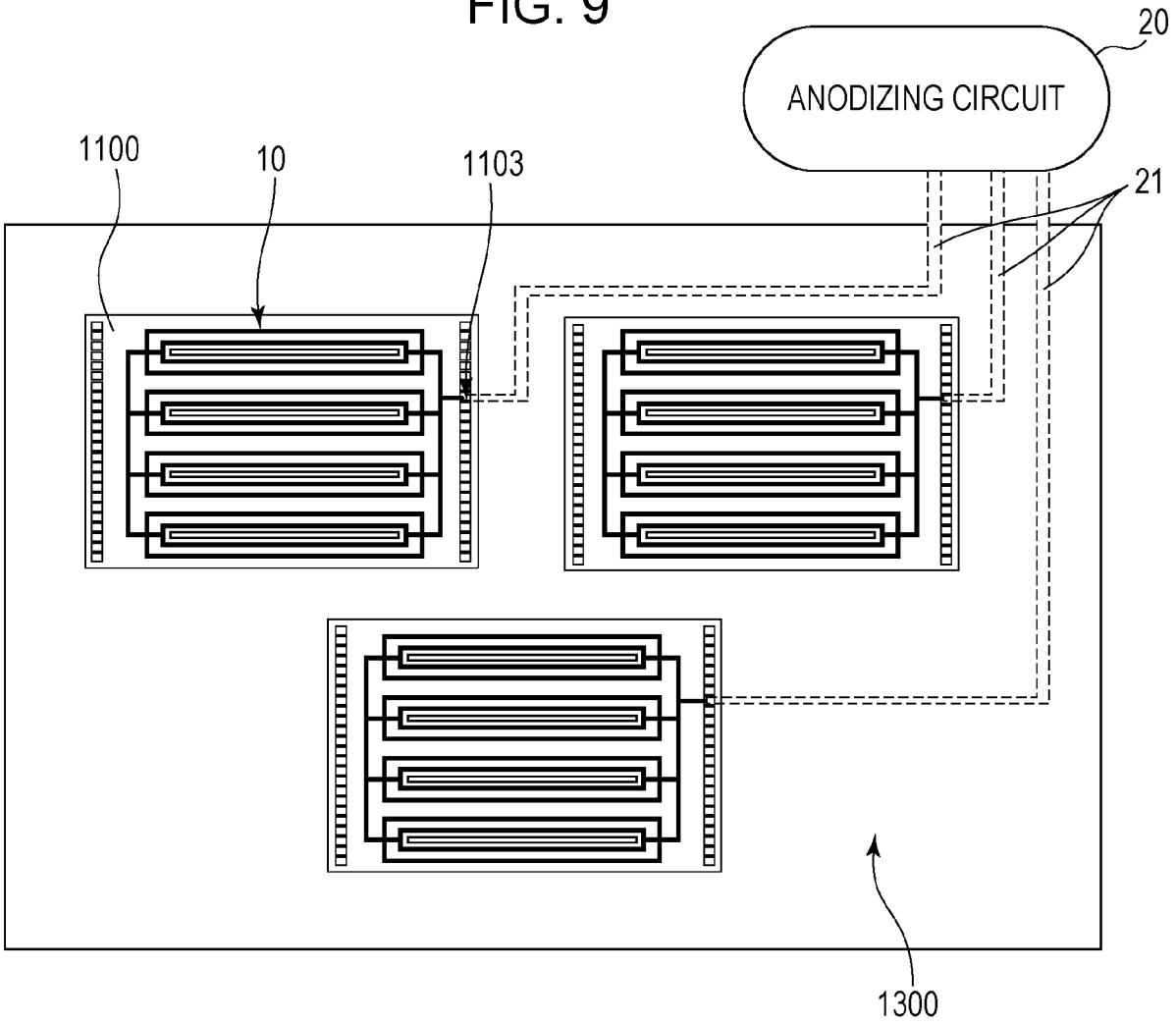
FIG. 9 is a schematic view illustrating connection between a plurality of recording element substrates and an anodizing circuit according to the first embodiment.

FIG. 1 is a schematic view illustrating a recording element substrate 1100 and an anodizing circuit 20 according to a first embodiment of the present invention. FIG. 9 is a schematic view illustrating connection between a plurality of the recording element substrates 1100 and the anodizing circuit 20 according to the first embodiment.

The recording element substrate 1100 includes a substrate 1108 and an ejection orifice member 1110. A plurality of ink supply holes 1101 are formed in the substrate 1108, and a plurality of protective films 10 are formed so as to correspond to the ink supply holes 1101. In the first embodiment, four ink supply holes are formed, and four sets of protective films are formed so as to correspond to the four ink supply holes. The sets of protective films are electrically connected to each other through wiring.

All the protective films 10 disposed in the recording element substrate 1100 are electrically connected to each other in the recording element substrate 1100. The protective films 10 are electrically connected to one of electrode terminals 1103 of the recording element substrate 1100.

A recording head 100 includes the anodizing circuit 20, which corresponds to an electrifying unit. As illustrated in FIG. 9, the anodizing circuit 20 and the electrode terminals 1103 are connected to each other through wires 21 in an electric wiring substrate 1300, and therefore the anodizing circuit 20 and the protective films 10 of the recording element substrate 1100 are electrically connected to each other.

The anodizing circuit 20 is capable of electrifying the protective films 10 in such a way that surfaces of the protective films 10 in contact with the ink serve as anodes. The anodizing circuit 20 determines whether or not to anodize the protective films 10 on the basis of the detection result obtained by the aforementioned anodization detection unit. Accordingly, the anodizing circuit 20 can actively anodize the protective films 10 of the recording element substrate 1100.

The anodizing circuit 20 is connected to the plurality of recording element substrates 1100 through the wires 21, which are independent from each other, so that the anodizing circuit 20 also functions as a control circuit that is capable of selecting the recording element substrates 1100 to be electrified. Accordingly, it is possible to individually anodize the protective films 10 of the recording element substrates 1100. Therefore, it is possible to appropriately anodize the protective films 10 of each of the recording element substrates 1100 depending on the presence/absence of anodization or the degree of anodization.

An electric power source used for electrification may be a dedicated electric power source for the anodizing circuit 20. Alternatively, an electric power source for driving the recording head 100 may be also used as the electric power source for the electrification.

Operation of Anodizing Circuit

Figure 10:
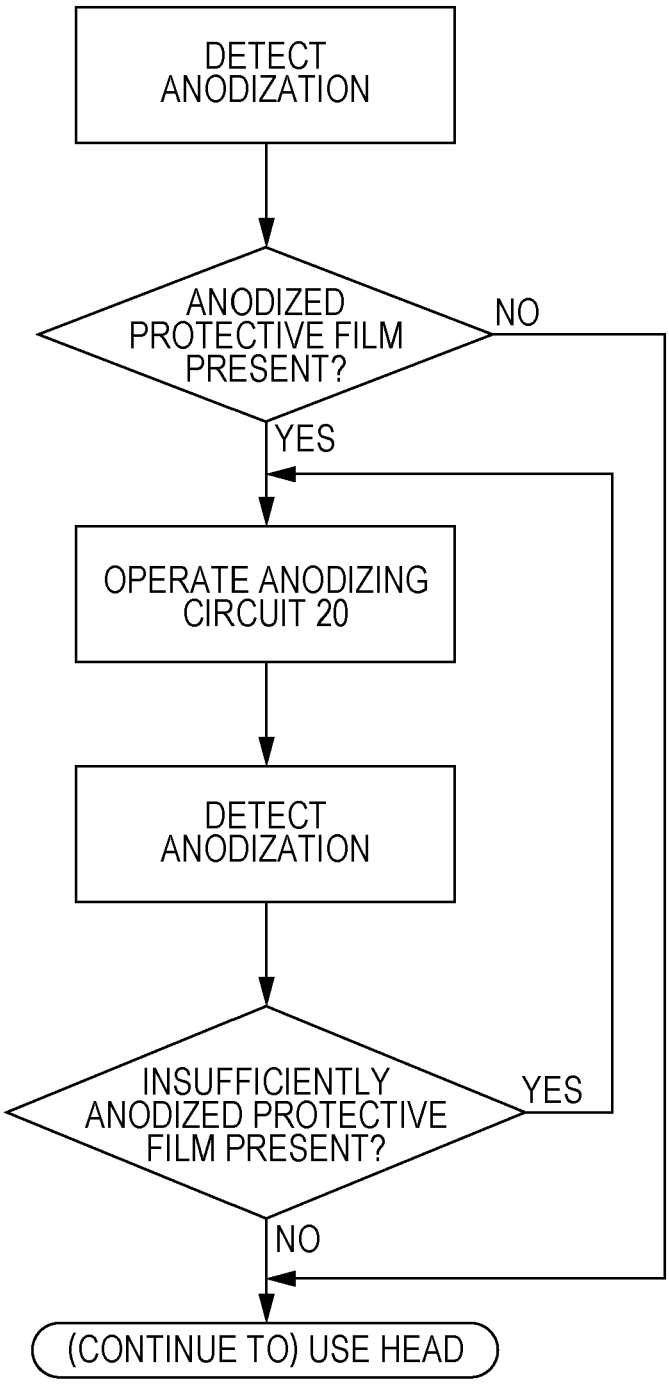
FIG. 10 is a flowchart of a process of anodizing a protective film using the anodizing circuit.

Referring to FIG. 10, an operation of the anodizing circuit 20 will be described. FIG. 10 is a flowchart of a process of anodizing the protective films 10 by using the anodizing circuit 20.

First, a detection unit detects the presence/absence of an anodized protective film 10 by using one of the aforementioned methods or the like. This detection may be performed when the recording head 100 is being used or when the recording head 100 is being manufactured.

If the presence of an anodized protective film 10 is detected, the anodizing circuit 20 selectively electrifies a recording element substrate 1100 including protective films 10 for which anodization is not detected, thereby actively anodizing the protective films 10 of the recording element substrate 1100. Thus, the protective films 10 of all the recording element substrate 1100 in the recording head 100 become anodized.

Moreover, in the first embodiment, the anodization detection unit examines further whether the protective films 10 of the recording element substrate 1100 have been anodized. If the presence of an insufficiently anodized protective film 10 is detected, the anodizing circuit 20 electrifies the recording element substrate 1100 including the protective film 10. By doing so, the plurality of recording element substrates 1100 can be uniformly anodized. Therefore, detection and electrification may be performed twice as described above.

Recording was performed by using the recording head 100 having the structure described above. Before the anodizing circuit 20 was operated, partial nonuniformity in recording was observed. After the anodizing circuit 20 was operated, nonuniformity in recording was not observed, and therefore it was confirmed that recording was performed appropriately.

As described above, according to the first embodiment, the protective films 10 can be anodized by using the anodizing circuit 20. Thus, nonuniformity in the thermal characteristics of the protective films 10 of the plurality of recording element substrates 1100 can be suppressed. Therefore, decrease in the recording quality of the recording head 100 can be suppressed and the reliability of the product can be increased. Moreover, the yield in manufacturing the recording head 100 can be increased, because a recording element substrate 1100 including a protective film 10 that is likely to be anodized can be used.

The anodizing circuit 20 may be provided in each of the recording element substrates 1100, or may be mounted in the body of the recording apparatus 3000.

Second Embodiment

Figure 11:
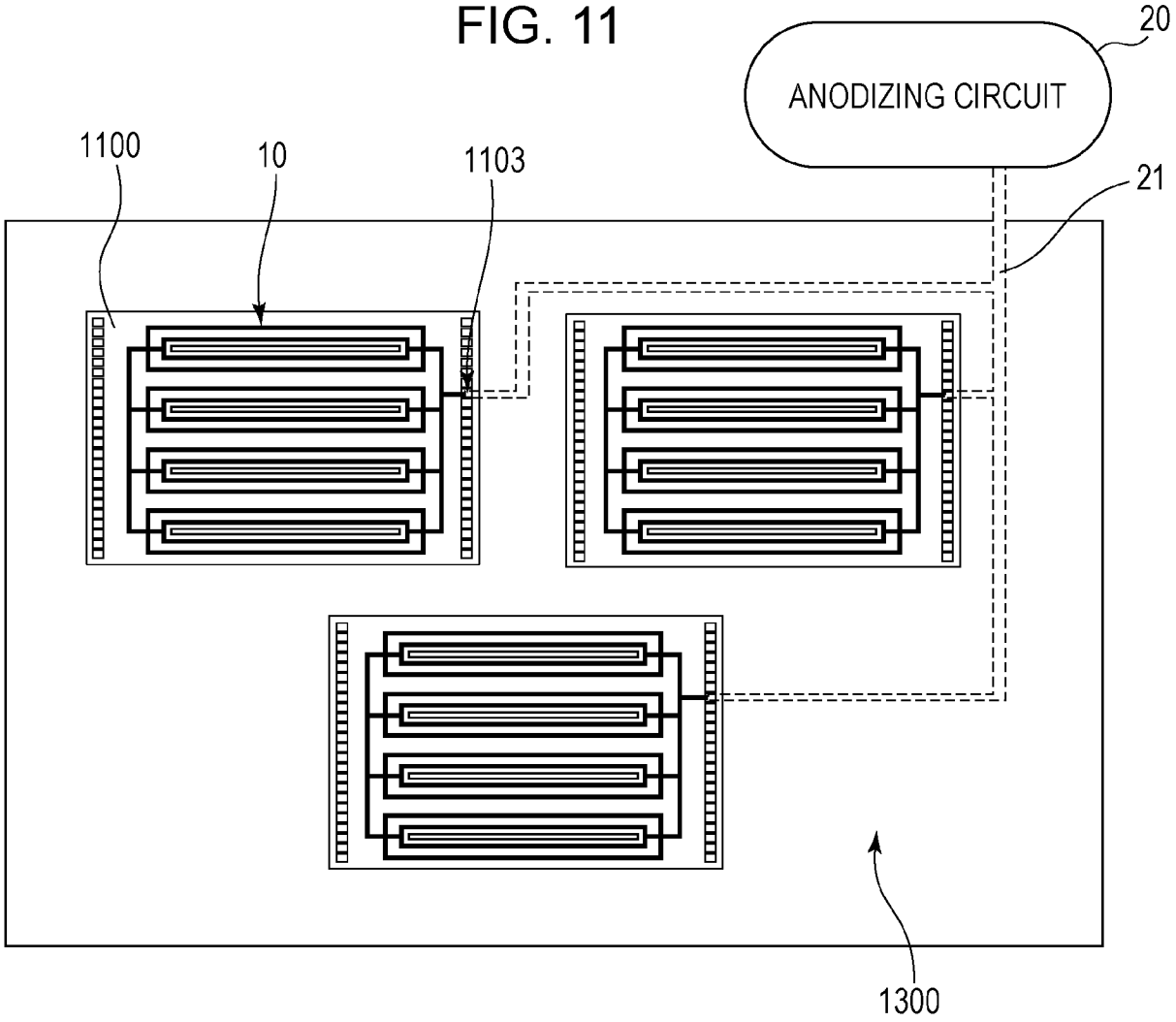
FIG. 11 is a schematic view illustrating connection between a plurality of recording element substrates and an anodizing circuit according to a second embodiment.

Referring to FIG. 11, a second embodiment of the present invention will be described. FIG. 11 is a schematic view illustrating connection between a plurality of recording element substrates 1100 and an anodizing circuit 20 according to the second embodiment.

In the first embodiment, the anodizing circuit 20 selectively electrifies the protective films 10 of the plurality of the recording element substrates 1100. In contrast, in the second embodiment, the anodizing circuit simultaneously electrifies the plurality of recording element substrates 1100. As illustrated in FIG. 11, the plurality of recording element substrates 1100 are connected to the anodizing circuit 20 through a wire 21, and the plurality of the protective films 10 of the recording element substrates 1100 are electrically connected to each other.

According to the second embodiment, a circuit for selecting the recording element substrate 1100 to be electrified is not necessary. Therefore, the circuit can be reduced in size. Moreover, because the number of wires for connecting an electric wiring substrate 1300 to the recording element substrate 1100 can be reduced, the electric wiring substrate 1300 and the recording head 100 can be reduced in size.

Regarding the operational flow of the anodizing circuit 20 shown in FIG. 10, in the first embodiment, only a recording element substrate 1100 that is not anodized is selectively electrified. In contrast, in the second embodiment, the plurality of recording element substrates 1100 are simultaneously electrified.

In the second embodiment, anodization is performed on the recording element substrate 1100 including a protective film 10 that has been anodized. However, because anodization of the protective film 10 occurs instantaneously, additional anodization has only a small effect. Accordingly, even when additional anodization is performed on a protective film 10 that has been anodized due to a defect in the recording element substrate 1100, the recording quality is only negligibly affected. As a result, the structure according to the second embodiment may be used.

Third Embodiment

Figure 12:
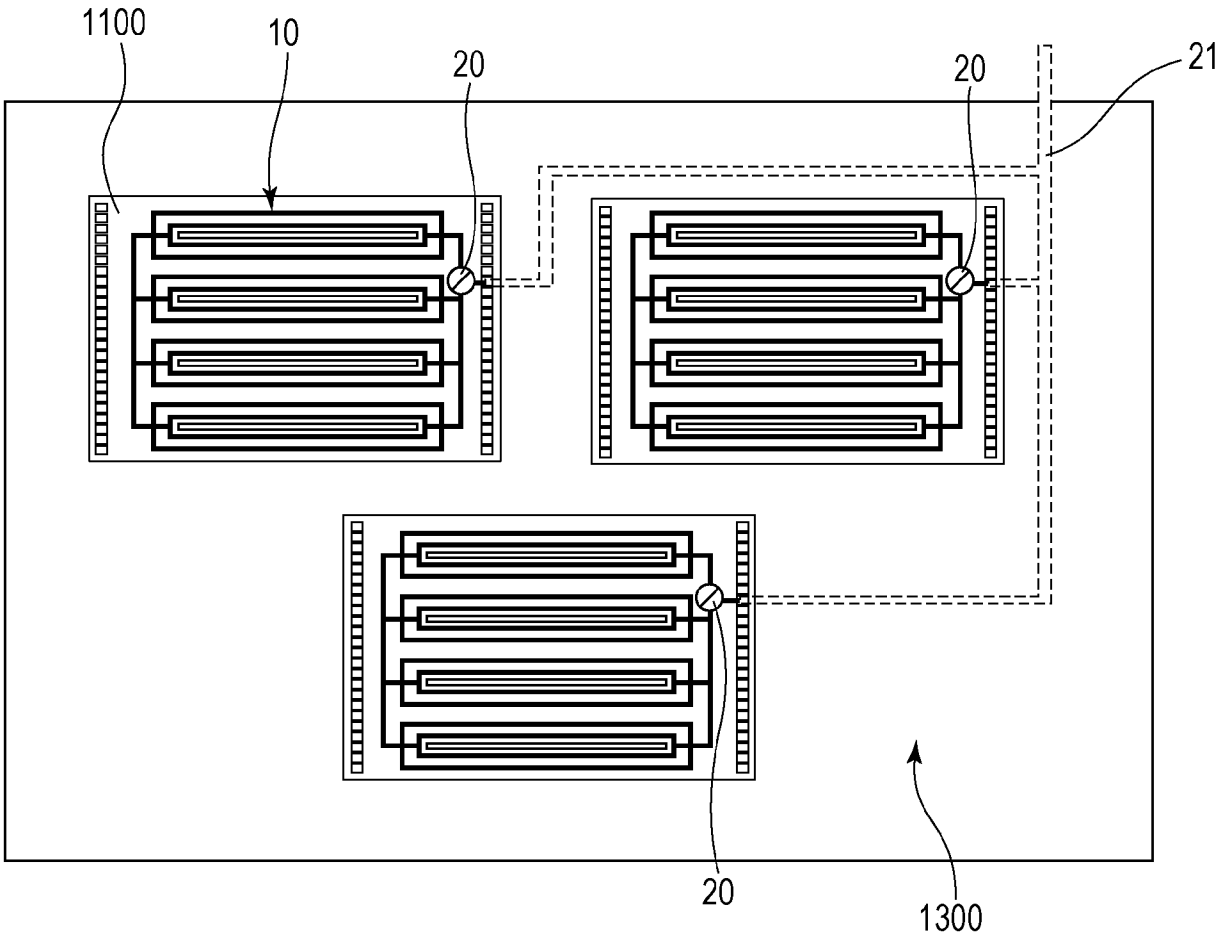
FIG. 12 is a schematic view illustrating connection between a plurality of recording element substrates and an anodizing circuit according to a third embodiment.

Referring to FIG. 12, a third embodiment of the present invention will be described. FIG. 12 is a schematic view illustrating connection between a plurality of recording element substrates 1100 and anodizing circuits 20 according to the third embodiment.

In the third embodiment, each of the anodizing circuits 20 is provided in a corresponding one of the recording element substrates 1100. Also in the third embodiment, the presence/absence of anodization is detected as shown in the operational flow of the anodizing circuit 20 shown in FIG. 10. On the basis of the detection result, the anodizing circuit 20 of the recording element substrate 1100 including the protective film 10 that needs to be anodized is operated. In the third embodiment, the anodizing circuit 20 is operated by, for example, using electric power that is supplied from the inkjet recording apparatus 3000 to drive the electrothermal transducers 14 of the recording element substrate 1100. Whether or not to operate the anodizing circuit 20 can be controlled by controlling supply of electric power by using part of data signals sent from the recording apparatus 3000 when recording is performed.

In the third embodiment, electrification for anodizing the protective films 10 of each recording element substrate 1100 can be performed by using electric power supplied to the recording element substrate 1100 to drive the electrothermal transducer 14 or electric power for a driving circuit. Thus, it is not necessary to provide the electric wiring substrate 1300 with wires 21 dedicated for the anodizing circuit 20, and therefore increase in the size of the electric wiring substrate 1300 can be suppressed.

Figure 13:
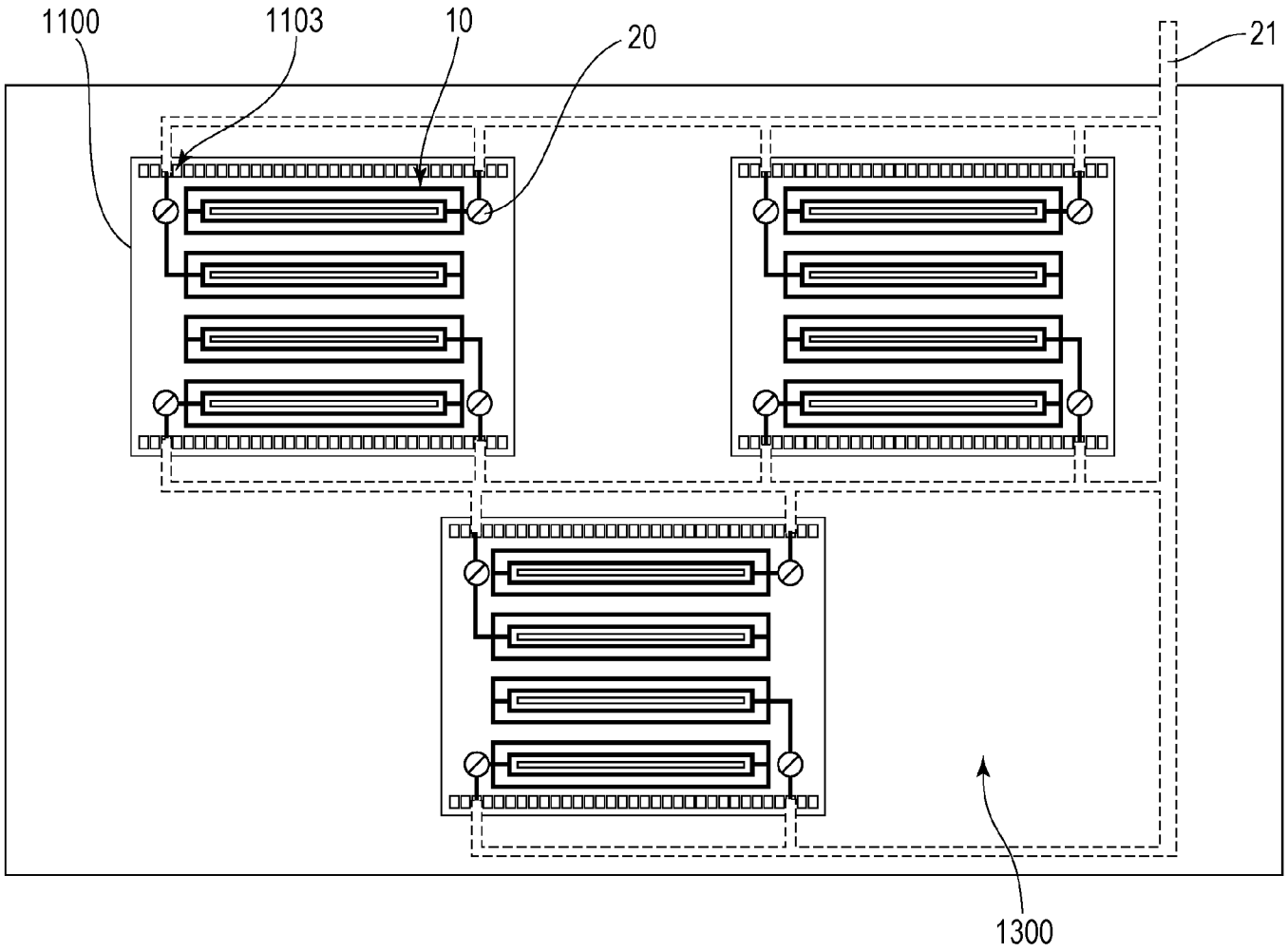
FIG. 13 illustrates a modification of the third embodiment.

FIG. 13 illustrates a modification of the third embodiment. In the third embodiment described above, the protective films 10 in each recording element substrate 1100 are electrically connected to each other in the recording element substrate 1100. In the present modification, a plurality of protective films 10, which are provided in each recording element substrate 1100, are not connected to each other in the recording element substrate 1100.

As illustrated in FIG. 13, in the present modification, the anodizing circuit 20 is provided for each of sets of protective films 10 that are electrically independent from each other. Thus, in one recording element substrate 1100, it is possible to electrify only a set of protective films 10 that needs to be anodized.

The recording head 100 in the embodiments described above is a full-line recording head. However, this is not a limitation, and the present invention can be applied to a recording head 100 of any type that includes a plurality of recording element substrates 1100.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-187347, filed Sep. 10, 2013, which is hereby incorporated by reference herein in its entirety.

What is claimed is:

1. A liquid ejection apparatus comprising:

an energy generating element that generates energy for ejecting a liquid;

an insulation film covering the energy generating element;

a plurality of electroconductive protective films that are disposed so as to cover the energy generating element and the insulation film, and that are in contact with the liquid; and an electrifying unit that is capable of electrifying the plurality of electroconductive protective films in such a way that surfaces of the electroconductive protective films in contact with the liquid serve as anodes.

2. The liquid ejection apparatus according to claim 1, comprising:

a liquid ejection head including a plurality of recording element substrates each including the energy generating element and the electroconductive protective films.

3. The liquid ejection apparatus according to claim 2, wherein the electrifying unit is capable of individually electrifying the electroconductive protective films of the plurality of recording element substrates.

4. The liquid ejection apparatus according to claim 2, wherein the electrifying unit is electrically connected to the electroconductive protective films of the plurality of recording element substrates and is capable of selecting at least one of the electroconductive protective films to be electrified.

5. The liquid ejection apparatus according to claim 2, wherein the electrifying unit is capable of simultaneously electrifying the electroconductive protective films of the plurality of recording element substrates.

6. The liquid ejection apparatus according to claim 1, further comprising:

a detection unit that detects anodization of the electroconductive protective films.

7. The liquid ejection apparatus according to claim 6, wherein in a case where the anodization of the electroconductive protective film is detected by the detection unit, the electrifying unit electrifies to anodize an electroconductive protective film not being anodized.

8. A liquid ejection head comprising:

a plurality of recording element substrates each including:

a member having an ejection orifice from which a liquid is ejected, and a substrate including:

an energy generating element that generates energy for ejecting the liquid, an insulation film covering the energy generating element, and an electroconductive protective film that is disposed so as to cover the energy generating element and the insulation film; and an electrifying unit that is capable of electrifying the electroconductive protective films of the plurality of recording element substrates in such a way that surfaces of the electroconductive protective films in contact with the liquid serve as anodes.

9. The liquid ejection head according to claim 8, wherein the electrifying unit is provided in each of the recording element substrates.

10. The liquid ejection head according to claim 8, wherein the electrifying unit electrifies the electroconductive protective films by using an electric power source for driving the energy generating elements.

11. The liquid ejection head according to claim 8, wherein the electrifying unit electrifies the electroconductive protective films by receiving supply of electric power that is controlled by using a signal for driving the energy generating elements.

12. The liquid ejection head according to claim 8, further comprising a detection unit that detects anodization of the electroconductive protective films, wherein in a case where the anodization of the electroconductive protective film is detected by the detection unit, the electrifying unit electrifies to anodize an electroconductive protective film not being anodized.

13. The liquid ejection head according to claim 8, wherein the protective film includes tantalum.

14. A liquid ejection head comprising:

a first recording element substrate and a second recording element substrate each including:

an energy generating element that generates energy for ejecting a liquid, an insulation film covering the energy generating element, and an electroconductive protective film that is disposed so as to cover the energy generating element and the insulation film; and an electrifying unit that is capable of electrifying the electroconductive protective films of the first and second recording element substrates in such a way that surfaces of the electroconductive protective films in contact with the liquid serve as anodes.

15. The liquid ejection head according to claim 14, wherein the electrifying unit is provided in the first recording element substrate.

16. The liquid ejection head according to claim 14, wherein the electrifying unit electrifies the electroconductive protective films by using an electric power source for driving the energy generating elements.

17. The liquid ejection head according to claim 14, wherein the electrifying unit electrifies the electroconductive protective films by receiving supply of electric power that is controlled by using a signal for driving the energy generating elements.

18. The liquid ejection head according to claim 14, wherein in a case where anodization of the electroconductive protective film of the first recording element substrate is detected by a detection unit that detects the anodization of the electroconductive protective film, the electrifying unit electrifies to anodize an electroconductive protective film of the second recording element substrate not being anodized.

19. The liquid ejection head according to claim 14, wherein the protective film includes tantalum.

* * * * *